US005455151A

United States Patent [19]

Matejec

[11] Patent Number: 5,455,151

[45] Date of Patent: Oct. 3, 1995

[54] COLOR PHOTOGRAPHIC SILVER HALIDE MATERIAL

[75] Inventor: Reinhart Matejec, Leverkusen, Germany

[73] Assignee: Agfa Gevaert AG

[21] Appl. No.: 273,202

[22] Filed: Jul. 11, 1994

[30] Foreign Application Priority Data

Jul. 22, 1993 [DE] Germany ..... 43 24 617.6

[51] Int. Cl.[6] ..... G03C 1/46

[52] U.S. Cl. ..... 430/505; 430/506; 430/567; 430/543; 430/544; 430/957

[58] Field of Search ..... 430/506, 505, 430/567, 543, 544, 957, 503

[56] References Cited

U.S. PATENT DOCUMENTS

| | | | |
|---|---|---|---|
| 4,388,401 | 6/1983 | Hasebe et al. | 430/506 |
| 4,547,458 | 10/1985 | Iijima et al. | 430/506 |
| 4,804,619 | 2/1989 | Yamada et al. | 430/505 |

FOREIGN PATENT DOCUMENTS

| | | |
|---|---|---|
| 0108250 | 10/1983 | European Pat. Off. . |
| 0345553 | 5/1989 | European Pat. Off. . |
| 0474166 | 9/1991 | European Pat. Off. . |

*Primary Examiner*—Richard L. Schilling
*Assistant Examiner*—Geraldine Letscher
*Attorney, Agent, or Firm*—Connolly & Hutz

[57] ABSTRACT

Colour photographic silver halide material with at least two blue-sensitive yellow-coupling, two green-sensitive magenta coupling and two red-sensitive cyan coupling silver halide emulsion layers of differing photographic sensitivity, in which the silver halide emulsion of the highest sensitivity blue-sensitive and the highest sensitivity green-sensitive layers have an iodide content of ≦4 mol % and an average particle size of ≧0.65 μm and the silver halide emulsions of the lowest sensitivity blue-sensitive and the lowest sensitivity green-sensitive layers have an iodide content of ≧8 mol % and an average particle size of ≦0.3 μm and which material contains at least one DIR compound in an effective quantity, the inhibitor of which has diffusibility of ≧0.4, is characterised by great sharpness and very good colour separation.

10 Claims, No Drawings

COLOR PHOTOGRAPHIC SILVER HALIDE MATERIAL

The invention relates to a colour photographic silver halide material with at least two blue-sensitive, yellow-coupling silver halide emulsion layers of differing photographic sensitivity, at least two green-sensitive, magenta-coupling silver halide emulsion layers of differing photographic sensitivity and at least two red-sensitive, cyan-coupling silver halide emulsion layers of differing photographic sensitivity, which material contains at least one DIR compound in an effective quantity, the inhibitor of which has diffusibility of ≧0.4, and which is characterised by great sharpness and very good colour separation.

The best possible colour separation is of particular importance in order to achieve good colour reproduction. Apart from the lowest possible secondary colour densities and good masking, the lowest possible secondary sensitivity of the photographic layers in the ranges of the spectrum for which they are not intended is also necessary to this end. Blue/green differentiation is particularly critical in this connection. It is known that silver halide emulsions with a high iodide content have a particularly disadvantageous effect in this range of the spectrum; a high iodide content in the blue-sensitive, yellow-coupling layers increases their green sensitivity, while a high iodide content in the green-sensitive, magenta-coupling layers increases their blue sensitivity.

Colour separation may be improved by using so-called DIR couplers, in particular those DIR couplers the inhibitor of which is highly diffusible, whether with or without a restrainer.

The object of the invention was to improve not only colour separation, but sharpness as well.

It is known that silver halide grains with an average diameter of a sphere of equal volume of 0.3 to 0.4 μm cause maximum scattering of light within the visible spectrum and thus have a particularly severe impact on sharpness. While light scattering is indeed reduced and sharpness consequently increased if smaller grains are used, grain instability is also increased: during precipitation, ripening or digestion of the pouring solution, the grains tend to increase in size due to Ostwald ripening both before and during pouring, giving rise to grains with an average diameter which is again within the unfavourable range.

It has now been found that disadvantageous Ostwald ripening may be avoided in a material of the initially stated kind, if high-iodide, fine-grain emulsions are used in the low sensitivity blue- and green-sensitive layers, without there being any degradation of blue/green colour separation.

The present invention thus provides a colour photographic silver halide material of the initially stated kind, which is characterised in that the silver halide emulsion of the highest sensitivity blue-sensitive and the highest sensitivity green-sensitive layers have an iodide content of ≦4 mol % and an average particle size of ≧0.65 μm and the silver halide emulsions of the lowest sensitivity blue-sensitive and the lowest sensitivity green-sensitive layers have an iodide content of ≧8 mol % and an average particle size of ≦0.3 μm.

The emulsions are preferably silver bromide-iodide or silver bromide-iodide-chloride emulsions with a chloride content of less than 20 mol %. Silver bromide-iodide emulsions are preferred.

The iodide content of the highest sensitivity blue- and green-sensitive emulsion is preferably 1 to 4 mol %, that of the lowest sensitivity blue- and green-sensitive emulsions preferably 8 to 11 mol %.

The grain size of the highest sensitivity blue- and green-sensitive emulsions is preferably 0.65 to 1.3 μm, that of the lowest sensitivity blue- and green-sensitive emulsion preferably 0.1 to 0.25 μm, expressed as the diameter of a sphere of equal volume.

DIR couplers with highly diffusible inhibitors may be of various classes and are fundamentally known (for example DE 38 19 469 and DE 38 05 173). The method for determining diffusibility is described in EP 115 302 and EP 345 553.

The material according to the invention preferably contains 50 to 500 mg of the DIR compounds with highly diffusible inhibitors per $m^2$.

The DIR compounds to be used according to the invention are, in particular, of the formula $$A—(L)_n—B$$

in which

A means the residue of a compound which, on reacting with the oxidation product of the colour developer, liberates the group $—(L)_n—B$, in particular the residue of a coupler which liberates the residue $—(L)_n—B$ on coupling, B means the residue of a development inhibitor which is liberated from the group $—(L)_n—B$, L means a divalent binding link which, once the A—L bond is broken, is capable of breaking the L—B bond and n means 0 or 1.

Preferred residues B are of the following formulae:

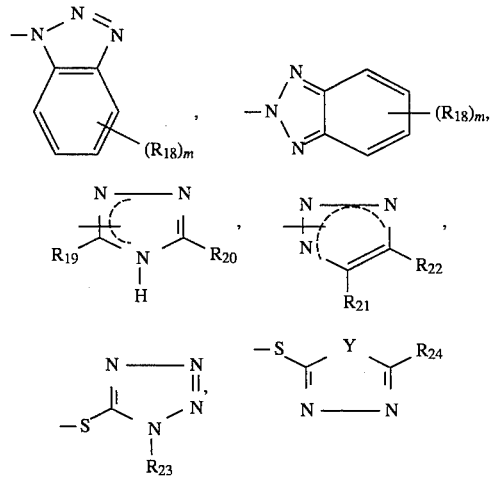

wherein

Y means O, or $NR_{25}$ and $R_{18}$ means H, an unsubstituted or substituted unbranched, branched or cyclic aliphatic residue, halogen, $—NCOR_{31}$, $—OR_{31}$,

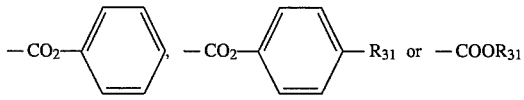

$R_{19}$ means H, halogen, an unsubstituted or substituted unbranched, branched or cyclic aliphatic residue, $—SR_{31}$, —S—aryl, —S—hetaryl, $R_{20}$ means an unsubstituted or substituted unbranched, branched or cyclic aliphatic residue, —$SR_{31}$, aryl or hetaryl, $R_{21}$ means hydrogen, an unsubstituted or substituted unbranched, branched or cyclic aliphatic residue or an aryl residue, $R_{22}$ means an unsubstituted or substituted unbranched, branched or cyclic aliphatic residue, —$SR_{31}$, —S—$(CH_2)_n$—$COOR_{32}$, $R_{23}$ means an unsubstituted or substituted unbranched, branched or cyclic aliphatic residue or a phenyl group which is unsubstituted or substituted with hydroxy, amino, sulphanoyl, carboxy or methoxycarbonyl, $R_{24}$ means an unsubstituted or substituted unbranched, branched or cyclic aliphatic residue, aryl, hetaryl, —$SR_{31}$ or an acylamino group, $R_{25}$ means H, an unsubstituted or substituted unbranched, branched or cyclic aliphatic residue, aryl, an acylamino group or a benzylideneamino group, $R_{31}$ means an unsubstituted or substituted unbranched, branched or cyclic aliphatic residue, $R_{32}$ means an unsubstituted or substituted unbranched, branched or cyclic aliphatic residue or an optionally substituted aryl residue m means 1 or 2 and n means 1 to 4.

Preferred —L—B groups are of the formulae:

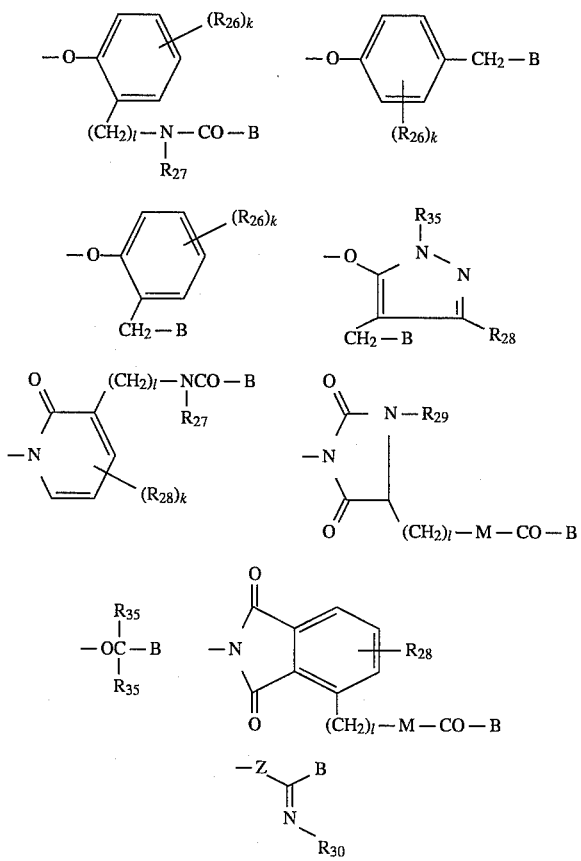

in which k means 1 or 2, l means 0, 1 or 2, $R_{26}$ means hydrogen, alkyl, aryl, hetaryl, halogen, nitro, cyanogen, alkylthio, acylamino, sulphamoyl, alkoxycarbonylamino or amino, $R_{27}$ means hydrogen, alkyl, aryl or aralkyl, $R_{28}$ means hydrogen, halogen, alkyl, aralkyl, alkoxy, anilino, acylamino, ureido, cyanogen, sulphonamido, aryl or carboxy, $R_{29}$ means hydrogen, alkyl, aralkyl, cycloalkyl or aryl, M means

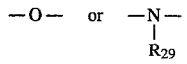

$R_{30}$ means alkyl, aralkyl, aryl, acyl, hetaryl, acylamino, —$OR_{33}$ or —$PO(OR_{33})_2$, $R_{33}$ means alkyl, aryl or hetaryl, Z means

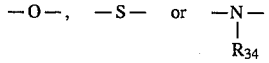

$R_{34}$ means hydrogen, alkyl, aryl, alkylsulphonyl or arylsulphonyl and $R_{35}$ means hydrogen, alkyl or aryl.

The substituents particularly preferably have the following meanings:

$R_{18}$: H, $CH_3$, Cl, Br, $C_1$–$C_6$ alkoxy, $C_1$–$C_6$ alkylcarbonylamino, phenoxycarbonyl, $R_{19}$: $C_1$–$C_{10}$ alkylthio, $R_{20}$: H, 2-furyl, $R_{21}$: H, $C_1$–$C_4$ alkyl, $R_{22}$: $C_1$–$C_6$ alkylthio, $C_1$–$C_8$ alkoxycarbonyl, $C_1$–$C_6$-alkylcarbonyloxy-$C_1$ –$C_4$-alkenethio, $R_{23}$: $C_1$–$C_6$ alkyl, optionally substituted with di-$C_1$–$C_4$-alkylamino, phenyl, optionally mono- or di-substituted with hydroxy, $C_1$–$C_4$ alkyl, methoxycarbonyl, aminosulphonyl or chloroethoxycarbonyl, $R_{24}$: $C_1$–$C_6$ alkyl, amino, 2-furyl, $R_{25}$: H, $C_1$–$C_6$ alkylcarbonylamino or

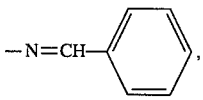

$R_{26}$: $NO_2$, $R_{27}$: $C_1$–$C_4$ alkyl, $R_{28}$: $C_1$–$C_{20}$ alkyl or phenyl, $R_{29}$: H, $C_1$–$C_4$ alkyl, $R_{30}$: phenyl, optionally substituted with chlorine, $R_{35}$: phenyl, nitrophenyl, Z: oxygen.

The following are examples of DIR couplers with highly diffusible inhibitors (diffusibility value stated in brackets):

DIR-1 (0,48)
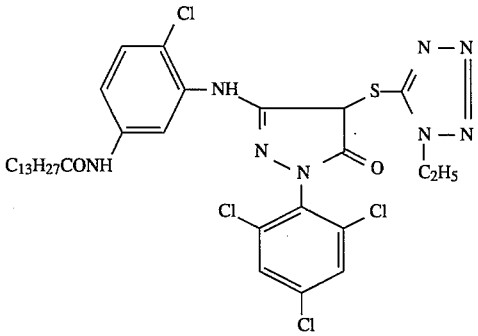
DIR-2 (0,40)
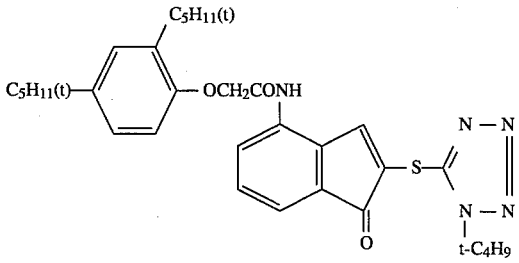
DIR-3 (0,48)
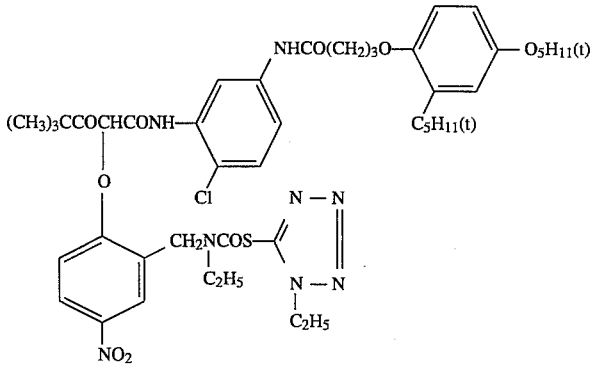
DIR-4 (0,42)
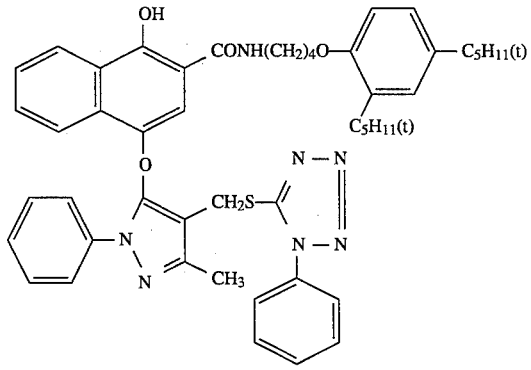
DIR-5 (0,76)
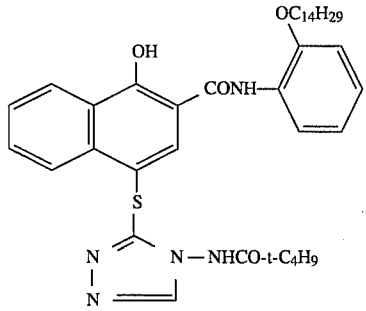

-continued
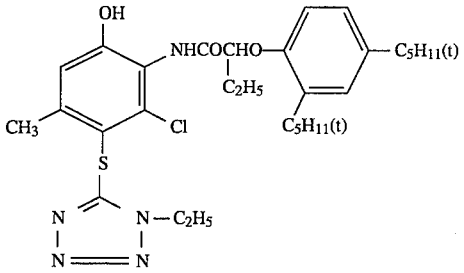
DIR-6 (0,48)
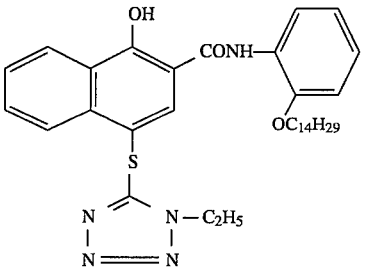
DIR-7 (0,48)
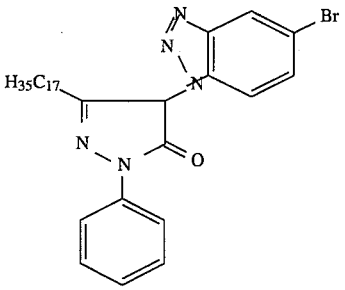
DIR-8 (0,90)
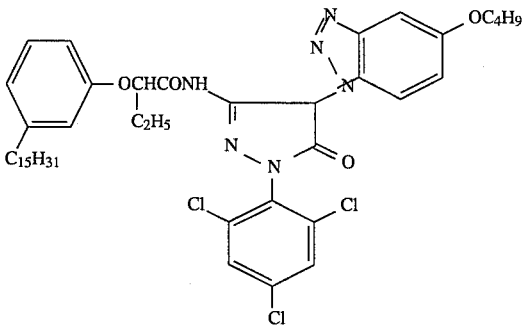
DIR-9 (0,70)
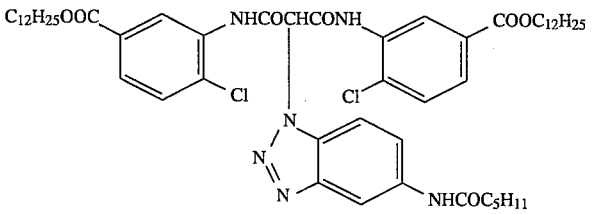
DIR-10 (0,84)

-continued
DIR-11 (0,48)
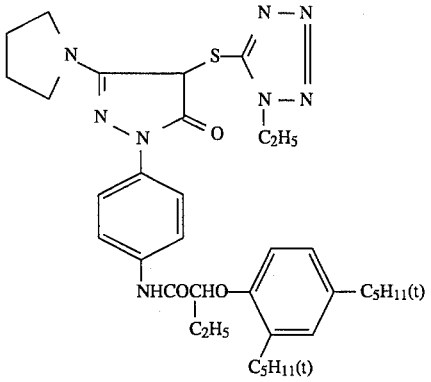
DIR-12 (0,74)
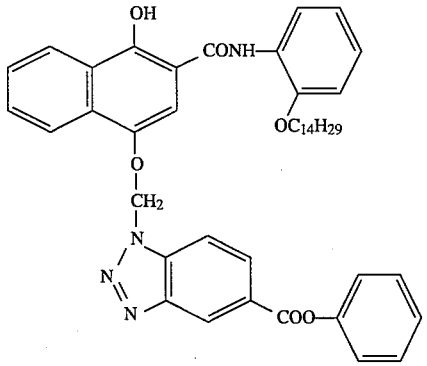
DIR-13 (0,45)
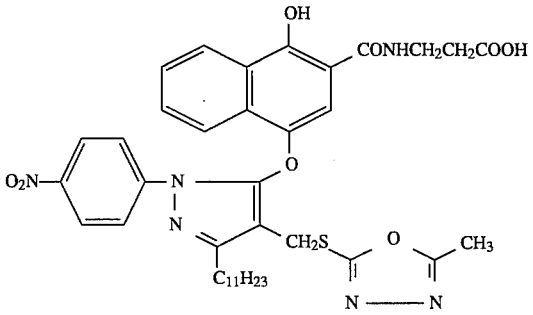
DIR-14 (0,45)
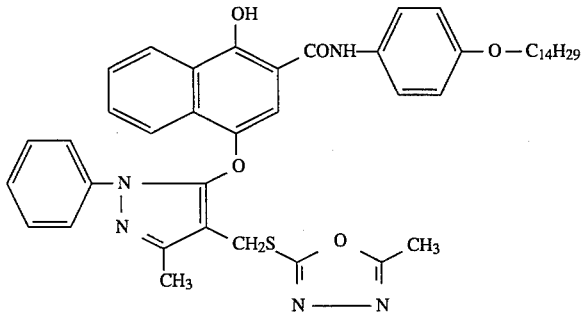

-continued
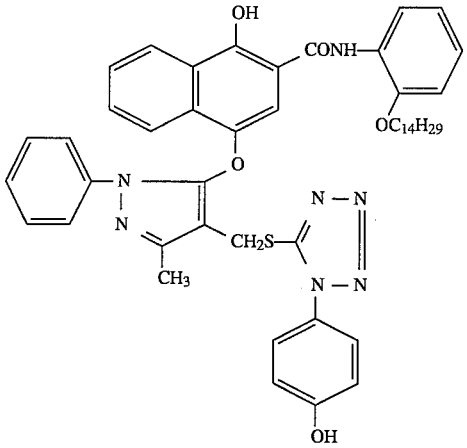
DIR-15 (0,59)
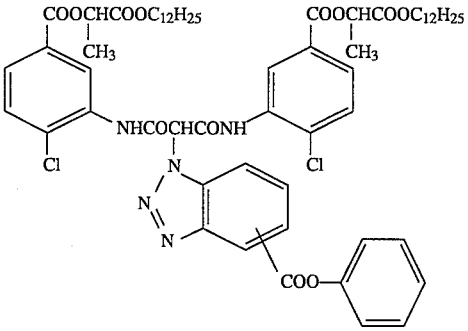
DIR-16 (0,74)
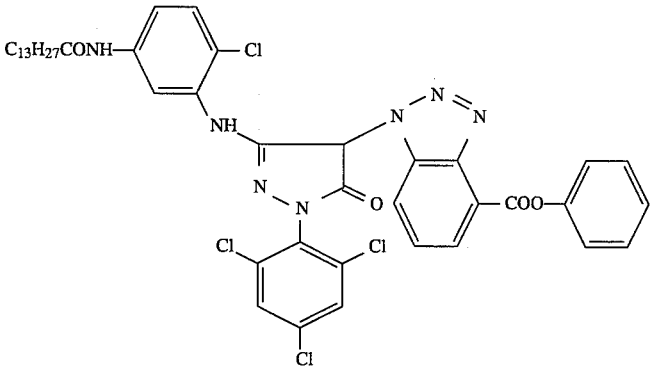
DIR-17 (0,74)
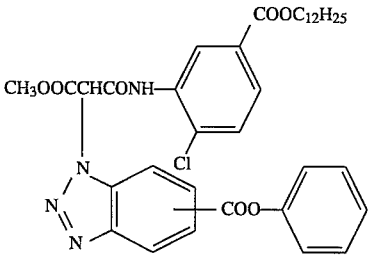
DIR-18 (0,74)

-continued
DIR-19 (0,54)
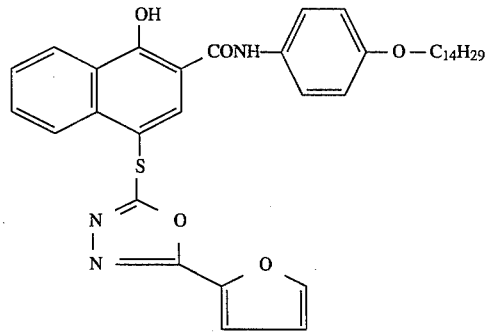
DIR-20 (0,67)
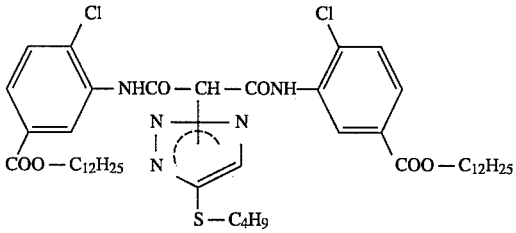
DIR-21 (0,76)
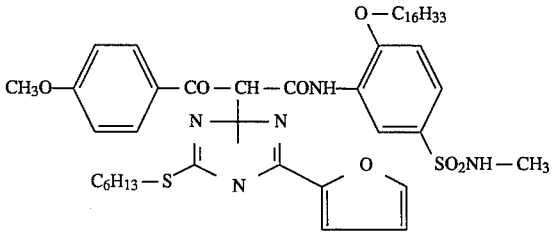
DIR-22 (0,47)
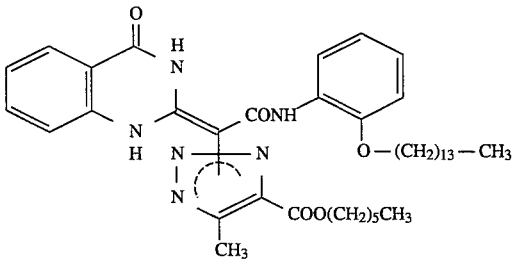
DIR-23 (0,62)
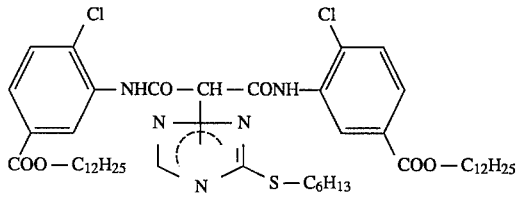
DIR-24 (0,67)
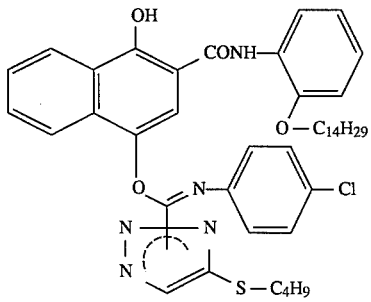

-continued
DIR-25 (0,62)
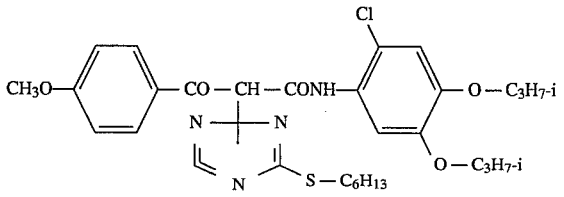
DIR-26 (0,74)
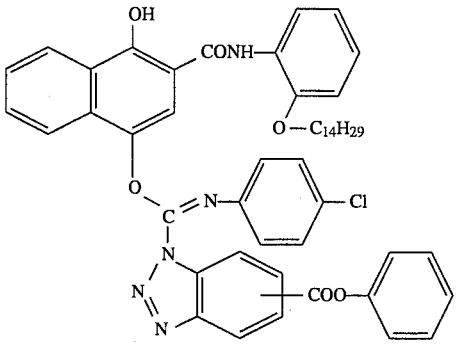
DIR-27 (0,48)
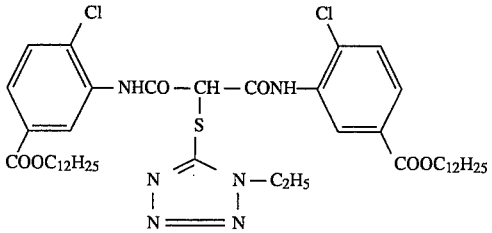
DIR-28 (0,52)
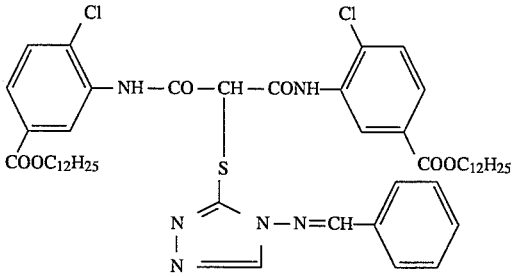
DIR-29 (0,78)
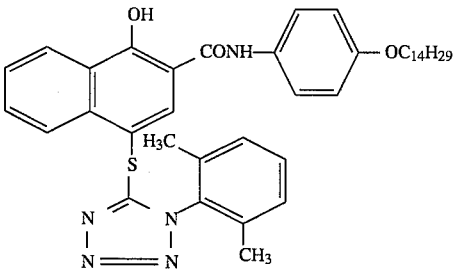
DIR-30 (0,67)
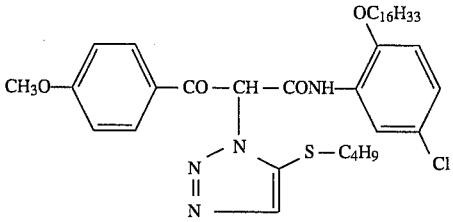

-continued

DIR-31 (0,67)

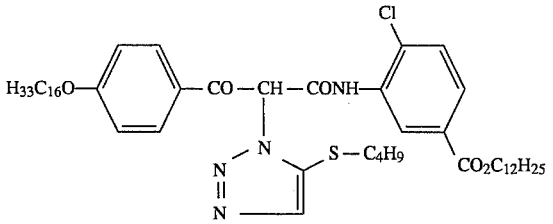

DIR-32 (0,85)

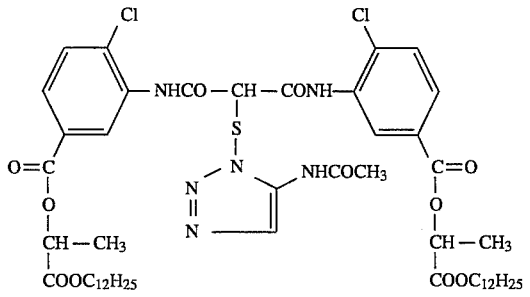

Unless otherwise provided by the parameters stated in the claims, the silver halide crystals may be predominantly compact, for example regularly cubic or octahedral, or they may have transitional shapes. Lamellar crystals may, however, also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals, in which the ratio of diameter to thickness is greater than 5:1, for example 12:1 to 30:1.

The average grain size of the emulsions, expressed as the diameter of a sphere of equal volume, is preferably between 0.15 μm and 2.0 μm, the grain size distribution may be both homodisperse and heterodisperse. The emulsions may, in addition to the silver halide, also contain organic silver salts, for example silver benzotriazolate or silver behenate.

Monodisperse emulsions are particularly preferred in which 70% of the emulsion grains have diameters with regard to a sphere of equal volume which are between 0.8 times and 1.3 times that of the most frequent sphere diameter.

Two or more types of silver halide emulsions which are produced separately may be used as a mixture.

The photographic emulsions may contain compounds to prevent fogging or to stabilise the photographic function during production, storage or photographic processing.

Particularly suitable are azaindenes, preferably tetra- and pentaazaindenes, particularly those substituted with hydroxyl or amino groups. Such compounds have been described, for example, by Birr, *Z. Wiss. Phot.*, 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, (substituted) benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (1978), section VI.

The stabilisers may be added to the silver halide emulsions before, during or after ripening of the emulsions. Naturally, the compounds may also be added to other photographic layers which are assigned to a silver halide layer.

Mixtures of two or more of the stated compounds may also be used.

The silver halide emulsions are customarily chemically ripened, for example under the action of gold compounds, other noble metal compounds, reducing agents and/or compounds of divalent sulphur.

The photographic emulsion layers or other hydrophilic colloidal layers of the photosensitive material produced according to the invention may contain surface-active agents for various purposes, such as coating auxiliaries, to prevent formation of electric charges, to improve sliding properties, to emulsify the dispersion, to prevent adhesion and to improve photographic characteristics (e.g. acceleration of development, greater contrast, sensitisation etc.).

The photographic emulsions may be spectrally sensitised using methine dyes or other dyes. Cyanine dyes, merocyanine dyes and complex merocyanine dyes are particularly suitable.

Sensitisers may be dispensed with if the intrinsic sensitivity of the silver halide is sufficient for a specific spectral range, for example the blue sensitivity of silver bromide.

Colour photographic materials customarily contain at least one red-sensitive, one green-sensitive and one blue-sensitive emulsion layer. These emulsion layers are assigned non-diffusing monomeric or polymeric colour couplers which may be located in the same layer or in an adjacent layer. Usually, cyan couplers are assigned to the red-sensitive layers, magenta couplers to the green-sensitive layers and yellow couplers to the blue-sensitive layers, wherein, according to the invention, magenta couplers of the formula (I) or (II) are used alone or mixed with other magenta couplers described below.

Colour couplers to produce the cyan partial colour image are generally couplers of the phenol or α-naphthol type; preferably 2-ureidophenol compounds and 1,5-aminonaphthol compounds.

Colour couplers to produce the yellow partial colour image are generally couplers with an open-chain ketomethylene grouping, in particular couplers of the α-acylacetamide type; preferred classes of couplers are α-benzoylacetanilide couplers and α-pivaloylacetanilide couplers, which are also known from the literature.

Colour couplers to produce the magenta partial colour image are generally couplers of the 5-pyrazolone, indazolone or pyrazoloazole type; preferred classes of couplers are pyrazoloazole and arylaminopyrazolone compounds.

The colour couplers may be 4-equivalent couplers, but they may also be 2-equivalent couplers. The latter are differentiated from 4-equivalent couplers by containing a substituent at the coupling position which is eliminated on coupling. 2-equivalent couplers are considered to be those which are colourless, as well as those which have an intense intrinsic colour which on colour coupling disappears or is replaced by the colour of the image dye produced (mask couplers), for example red mask couplers produced from a cyan coupler and a dye absorbing in the 510 to 590 nm range attached to the coupling position by means of an oxygen atom and optionally a binding link, and white couplers which, on reaction with colour developer oxidation products, give rise to substantially colourless products. 2-equivalent couplers are further considered to be those DIR couplers with highly diffusible inhibitors to be used according to the invention.

High-molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. High-molecular weight colour couplers are generally produced by polymerisation of ethylenically unsaturated monomeric colour couplers. They may, however, also be obtained by polyaddition or polycondensation.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular solubility of the compound.

Methods for the introduction of compounds which are essentially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Pat. No. 2,322,027, U.S. Pat. No. 2,801,170, U.S. Pat. No. 2,801,171 and EP-A-0 043 037.

Instead of high-boiling solvents, oligomers or polymers, so-called polymeric oil formers, may be used.

The compounds may also be introduced into the pouring solution in the form of filled latices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphoric acid esters, citric acid esters, benzoic acid esters, alkyl amides, fatty acid esters and trimesic acid esters.

The non-photosensitive interlayers generally arranged between layers of differing spectral sensitivity may contain agents which prevent an undesirable diffusion of developer oxidation products from one photosensitive layer to another photosensitive layer of differing spectral sensitisation.

Partial layers of the same spectral sensitisation may differ in composition, particularly in terms of the type and quantity of silver halide granules. In general, the partial layer with the greater sensitivity will be located further from the support than the partial layer with lower sensitivity. Partial layers of the same spectral sensitisation may be adjacent to each other or may be separated by other layers, for example layers of different spectral sensitisation, Thus, for example, all high sensitivity and all low sensitivity layers may be grouped together each in a package of layers (DE-A-19 58 709, DE-A-25 30 645, DE-A-26 22 922).

The photographic material may also contain UV light absorbing compounds, optical whiteners, spacers, filter dyes, formalin scavengers and others.

UV light absorbing compounds are intended on the one hand to protect the colour dyes from bleaching by high-UV daylight and on the other hand to absorb the UV light in daylight on exposure and so improve the colour reproduction of a film. Customarily, compounds of different structure are used for the two tasks. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Ultra-violet absorbing couplers (such as cyan couplers of the α-naphthol type) and ultra-violet absorbing polymers may also be used. These ultra-violet absorbents may be fixed into a special layer by mordanting.

Filter dyes suitable for visible light include oxonol dyes, hemioxonol dyes, styrene dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* December 1978, p. 22 et seq, reference 17463, section V.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-33 31 542, DE-A-34 24 893, *Research Disclosure* December 1978, p. 22 et seq, reference 17643, section XVI).

The average particle diameter of the spacers is in particular in the range from 0.2 to 10 μm. The spacers are insoluble in water and may be soluble or insoluble in alkali, wherein alkali-soluble spacers are generally removed from the photographic material in the alkaline developing bath. Examples of suitable polymers are polymethyl methacrylate, copolymers of acrylic acid and methyl methacrylate together with hydroxypropylmethylcellulose hexahydrophthalate.

The binders of the material according to the invention, particularly if gelatine is used as binder, are hardened with customary hardeners, for example with epoxy, ethyleneimine, acryloyl or vinyl sulphone type hardeners. Hardeners of the diazine, triazine or 1,2-dihydroquinoline series are also suitable.

The binders of the material according to the invention are preferably hardened with instant hardeners.

Instant hardeners are understood to be compounds which crosslink suitable binders in such a way that immediately after pouring, at the latest after 24 hours, preferably at the latest after 8 hours, hardening is concluded to such an extent that there is no further alteration in the sensitometry and swelling of the layered structure determined by the crosslinking reaction. Swelling is understood as the difference between the wet layer thickness and the dry layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which are capable of reacting with the free carboxyl groups of the gelatine, so that the latter react with free amino groups of the gelatine forming peptide bonds and crosslinking the gelatine.

EXAMPLE 1 (Comparison)

Layer Structure 1A

The following layers were applied in the sequence shown below to a transparent cellulose triacetate film base.

The quantities all relate to 1 $m^2$. The equivalent quantities of $AgNO_3$ are stated for the quantity of silver halide applied.

All the silver halide emulsions were stabilised with 0.1 g of 4-hydroxy-6-methyl-1,3,3a,7-tetraazaindene per 100 g of $AgNO_3$.

| | |
|---|---|
| **1st layer (anti-halo layer)** | |
| 0.2 g | black colloidal silver |
| 1.2 g | gelatine |
| 0.1 g | UV absorber UV 1 |
| 0.2 g | UV absorber UV 2 |
| 0.02 g | tricresyl phosphate |
| 0.03 g | dibutyl phthalate (DBP) |
| **2nd layer (micrate interlayer)** | |
| 0.25 g | $AgNO_3$ of an AgBrI emulsion; average grain diameter 0.07 gm, 0.5 mol % iodide; |
| 1.0 g | gelatine |
| 0.05 g | coloured coupler RM 1 |
| 0.10 g | tricresyl phosphate (TCP) |
| **3rd layer (low sensitivity red-sensitised layer)** | |
| 2.2 g | $AgNO_3$ of a red-sensitised AgBrI emulsion; 8.5 mol % iodide, average grain diameter 0.20 μm |
| 2.0 g | gelatine |
| 0.6 g | colourless cyan coupler C 1 emulsified in 0.5 g TCP |
| 50 mg | coloured cyan coupler RM 1 and |
| 80 mg | DIR coupler DIR 16 emulsified in 80 mg TCP |
| **4th layer (high sensitivity red-sensitised layer)** | |
| 2.8 g | $AgNO_3$ of a red-sensitised AgBrI emulsion; 8.5 mol % iodide, average grain diameter 0.8 μm |
| 1.8 g | gelatine |
| 0.15 g | colourless cyan coupler C 2 emulsified with 0.15 g DBP |
| **5th layer (separation layer)** | |
| 0.7 g | gelatine |
| 0.2 g | 2,5-diisooctylhydroquinone emulsified with 0.15 g DBP |
| **6th layer (low sensitivity green-sensitised layer)** | |
| 1.8 g | $AgNO_3$ of a green-sensitised AgBrI emulsion with 8.5 mol % iodide and an average grain diameter of 0.20 μm |
| 1.6 g | gelatine |
| 0.6 g | magenta coupler M 1 and |
| 50 mg | mask coupler YM 1 emulsified with 50 mg TCP, |

-continued

| | |
|---|---|
| 30 mg | DIR coupler DIR 30 emulsified in 20 mg DBP |
| **7th layer (high sensitivity green-sensitised layer)** | |
| 2.2 g | $AgNO_3$ of a green-sensitised AgBrI emulsion with 8.5 mol % iodide and an average grain diameter of 0.7 μm |
| 1.4 g | gelatine |
| 0.15 g | magenta coupler M 2 emulsified with 0.45 g TCP |
| 30 mg | mask coupler YM 1 emulsified with 30 mg TCP |
| **8th layer (separation layer)** | |
| 0.5 g | gelatine |
| 0.1 g | 2,5-diisooctylhydroquinone emulsified with 0.08 g DBP |
| **9th layer (yellow filter layer)** | |
| 0.2 g | Ag (yellow colloidal silver sol) |
| 0.9 g | gelatine |
| 0.2 g | 2,5-diisooctylhydroquinone emulsified with 0.16 g DBP |
| **10th layer (low sensitivity blue-sensitive layer)** | |
| 0.6 g | $AgNO_3$ of a blue-sensitised AgBrI emulsion with 8.5 mol % iodide, average grain diameter 0.20 μm |
| 0.85 g | gelatine |
| 0.7 g | yellow coupler Y 1 emulsified with 0.7 g TCP |
| 0.15 g | DIR coupler DIR 16 emulsified with 0.5 g TCP |
| **11th layer (high sensitivity blue-sensitive layer)** | |
| 1.0 g | $AgNO_3$ of a blue-sensitised AgBrI emulsion with 8.5 mol % iodide, average grain diameter 0.9 μm |
| 0.85 g | gelatine |
| 3 g | yellow coupler Y 1 emulsified with 0.3 g TCP |
| **12th layer (protective and hardening layer)** | |
| 0.5 g | of a micrate Ag(Br, I) emulsion, average grain diameter 0.07 μm, 0.5 mol % iodide |
| 1.2 g | gelatine |
| 0.4 g | hardener H 1 |
| 1.0 g | formaldehyde scavenger F 1 |

Layer Structures 1B to 1H

Layer structures 1B to 1H were produced in a similar manner to layer structure 1A with the variations in the 6th, 7th, 10th and 11th layers shown in table 1. The pouring solutions for the 6th and 10th layers of structures 1A, 1C, 1E and 1G were not digested before pouring, those for structures 1B, 1D, 1F and 1H were digested for 12 hours at 40° C.

The materials arising from structures 1A to 1H were, as stated below, exposed once with blue light and once with green light behind a grey step wedge for sensitometric measurement of colour separation (method described after examples) and processed using a colour negative process (*The British Journal of Photography* (1974), p. 597 and 598). The results are shown in table 1. Colour separation is stated in log (I.t) units.

A method of measuring sharpness of a photographic material using MTF (=modulation transfer function), is described in C. E. K. Mees and T. H. James, *The Theory of the Photographic Process,* 3rd edition, McMillan Co. (1966), p. 512.

TABLE 1 relating to example 1

| Layer stucture | mol % $I^-$ in 7th & 11th layer | 6th & 10 layer: mol % $I^-$ | 6th & 10 layer, before pouring: not digested | 6th & 10 layer, before pouring: digested for 12 h at 40° C. | Colour separation, blue/green with blue exposure: $\Delta E_{pp}$ (10%) | $\Delta E_{pp}$ (50%) | $\Delta E_{pp}$ (90%) | Colour separation, green/blue with green exposure: $\Delta E_{gb}$ (10%) | $\Delta E_{gb}$ (50%) | $\Delta E_{gb}$ (90%) | Sharpness on white exposure (MTF = 50% at γ lines/mm) |
|---|---|---|---|---|---|---|---|---|---|---|---|
| 1A | 8.5 | 8.5 | X | | 0.86 | 1.33 | 1.54 | 0.78 | 1.34 | 1.49 | 43 |
| 1B | 8.5 | 8.5 | | X | 0.86 | 1.34 | 1.56 | 0.79 | 1.35 | 1.50 | 41 |
| 1C | 8.5 | 3.0 | X | | 0.85 | 1.38 | 1.58 | 0.76 | 1.37 | 1.51 | 43 |
| 1D | 8.5 | 3.0 | | X | 0.87 | 1.40 | 1.57 | 0.78 | 1.38 | 1.53 | 31 |
| 1E | 3.0 | 3.0 | X | | 1.35 | 1.46 | 1.56 | 1.20 | 1.36 | 1.52 | 42 |
| 1F | 3.0 | 3.0 | | X | 1.34 | 1.48 | 1.58 | 1.22 | 1.39 | 1,50 | 32 |
| 1G | 3.0 | 8.5 | X | | 1.37 | 1.42 | 1.52 | 1.24 | 1.32 | 1.48 | 42 |
| 1H | 3.0 | 8.5 | | X | 1.36 | 1.43 | 1.56 | 1.22 | 1.36 | 1.50 | 41 |

pp = magenta
gb = yellow

Layer structures 1A to 1F are comparison structures, layer structures 1G and 1H are according to the invention.

It may be seen from table 1 that the blue/green ($\Delta E_{pp}$) colour separation with blue exposure and green/blue ($\Delta E_{gb}$) colour separation with green exposure are considerably lower at the lower colour densities (10%) in the structures (1A to 1D) with a high iodide content in the 7th and 11th layer than in the layer structures (1E to 1H) with a low iodide content in these layers, while in contrast the iodide content of the 6th and 10th layer surprisingly has almost no effect on colour separation over the entire range of colour densities.

On the other hand, sharpness was unchanged after digestion of the pouring solutions only in those layer structures (1B and 1H) in which the fine grains of the 6th and 10th layers had a high iodide content. In structures 1D and 1F, digestion made the low-iodide fine grains become coarser, growing to sizes of >0.25 μm.

EXAMPLE 2

In a similar manner to example 1, the following layer structures were produced on a transparent film base:

Layer Structure 2A (according to the invention)

Layer 1 (anti-halo layer)
Black colloidal silver sol with 0.2 g Ag
1.2 g gelatine
0.1 g UV absorber UV 1
0.2 g UV absorber UV 2
0.02 g tricresyi phosphate (TCP)
0.03 g dibutyl phthalate (DBP)

Layer 2 (micrate interlayer)
Micrate silver bromide-iodide emulsion (0.5 mol % iodide; average grain diameter 0.07 μm) prepared from 0.25 g $AgNO_3$ with
1.0 g gelatine Layer 3 (1st red-sensitised layer, low sensitivity)
Red-sensitised silver bromide-iodide emulsion (5.5 mol % iodide; average grain diameter 0.22 μm) prepared from -continued 1.20 g $AgNO_3$ with
1.15 g gelatine
0.52 g cyan coupler C 1
0.03 g red mask RM 1
0.04 g DIR coupler DIR 31
0.35 g TCP
0.25 g DBP Layer 4 (2nd red-sensitised layer, medium sensitivity)
Red-sensitised silver bromide-iodide emulsion (4.5 mol % iodide; average grain diameter 0.52 μm) prepared from 1.62 g $AgNO_3$ with
1.40 g gelatine
0.45 g cyan coupler C 3
0.02 g red mask RM 1
0.05 g DIR coupler DIR 31
0.30 g TCP
0.25 g DBP Layer 5 (3rd red-sensitised layer, high sensitivity)
Red-sensitised silver bromide-iodide emulsion (3.5 mol % iodide; average grain diameter 0.85 μm) prepared from 1.53 g $AgNO_3$ with
1.24 g gelatine
0.17 g cyan coupler C 4
0.03 g red mask RM 1
0.10 g TCP
0.08 g DBP Layer 6 (interlayer)

0.8 g gelatine
0.05 g 2,5-di-t-pentadecylhydroquinone
0.05 g TCP
0.05 g DBP

Layer 7 (1st green-sensitised layer, low sensitivity)
Green-sensitised silver bromide-iodide emulsion (9 mol % iodide; average grain diameter 0.20 μm) prepared from 1.06 g $AgNO_3$ with
0.85 g gelatine
0.36 g magenta coupler M 1
0.04 g yellow mask YM 1
0.04 g DIR coupler DIR 32

Layer 8 (2nd green-sensitised layer, medium sensitivity)
Green-sensitised silver bromide-iodide emulsion (4 mol % iodide; average grain diameter 0.55 μm) prepared from 1.25 g $AgNO_3$ with
1.05 g gelatine
0.38 g magenta coupler M 1
0.05 g yellow mask YM 1

-continued 0.04 g DIR coupler DIR 32
0.35 g TCP
0.15 g DBP
Layer 9 (3rd green-sensitive layer, high sensitivity)
Green-sensitised silver bromide-iodide emulsion (2.8 mol % iodide; average grain diameter 0.82 μm) prepared from 1.45 g $AgNO_3$ with
1.1 g gelatine
0.05 g magenta coupler M 3
0.02 g yellow mask YM 1
0.10 g TCP
0.10 g DBP
Layer 10 (yellow filter layer)
Yellow colloidal silver sol with 0.04 g Ag
0.8 g gelatine
0.15 g 2,5-di-t-pentadecylhydroquinone
0.40 g TCP
Layer 11 (1st blue-sensitive layer, low sensitivity)
Blue-sensitised silver bromide-iodide emulsion (10 mol % iodide; average grain diameter 0.18 μm) prepared from 0.70 g $AgNO_3$ with
1.2 g gelatine
0.9 g yellow coupler Y 2
0.10 g DIR coupler DIR 31
0.70 g TCP
0.20 g DBP
Layer 12 (2nd blue-sensitive layer, medium sensitivity)
Blue-sensitised silver bromide-iodide emulsion (5 mol % iodide; average grain diameter 0.5 μm) prepared from 0.4 g $AgNO_3$ with
0.51 g yellow coupler Y 2
0.85 g gelatine
0.10 g DIR coupler DIR 31
0.40 g TCP
0.20 g DBP
Layer 13 (3rd blue-sensitive layer, high sensitivity)
Blue-sensitised silver bromide-iodide emulsion (3.8 mol % iodide; average grain diameter 1.20 μm) prepared from 0.81 g $AgNO_3$ with
0.25 g yellow coupler Y 3
1.0 g gelatine
0.20 g TCP
Layer 14 (protective and hardening layer)
Micrate silver bromide-iodide emulsion (0.5 mol % iodide; average grain diameter 0.04 μm) prepared from 0.5 g $AgNO_3$ with
1.2 g gelatine
0.4 g hardener H 2
1.0 g formaldehyde scavenger F 1

In addition to this layer structure 2A (according to the invention), three further comparison structures (2B, 2C and 2D) were also produced with the following variations:

Layer Structure 2B as layer structure 2A, but in 7th layer having grains with an average diameter of 0.35 μm and in the 11th layer having grains with an average diameter of 0.35 μm.

Layer Structure 2C as layer structure 2A, but with comparison DIR couplers
in the 3rd layer 0.04 g DIR-V 1 instead of 0.04 g DIR 31
in the 4th layer 0.05 g DIR-V 1 instead of 0.05 g DIR 31
in the 7th layer 0.04 g DIR-V 2 instead of 0.04 g DIR 32
in the 8th layer 0.04 g DIR-V 2 instead of 0.04 g DIR 32
in the 11th layer 0.10 g DIR-V 3 instead of 0.10 g DIR 31
in the 12th layer 0.10 g DIR-V 3 instead of 0.10 g DIR 31

Layer structure 2D as layer structure 2A, but with the variations as in structures 2B and 2C.

The layer structures 2A to 2D of example 2 were exposed, processed and evaluated as in example 1. The results are shown in table 2.

In may be seen from table 2 that elevated colour separation and good sharpness are achieved simultaneously only in structure 2A according to the invention.

TABLE 2 relating to example 2

| Layer structure | DIR coupler in 3rd & 4th layer | DIR coupler in 7th & 8th layer | DIR coupler in 11th & 12th layer | Average grain diameter in 7th layer μm | Average grain diameter in 11th layer μm | Colour separation blue/green with blue exposure $\Delta E_{pp}$ (10%) | Colour separation blue/green with blue exposure $\Delta E_{pp}$ (50%) | Colour separation blue/green with blue exposure $\Delta E_{pp}$ (90%) | Colour separation green/blue with green exposure $\Delta E_{gb}$ (10%) | Colour separation green/blue with green exposure $\Delta E_{gb}$ (50%) | Colour separation green/blue with green exposure $\Delta E_{gb}$ (90%) | Sharpness on white exposure (MTF = 50% at γ lines/mm) |
|---|---|---|---|---|---|---|---|---|---|---|---|---|
| 2A (invention) | DIR 31 | DIR 32 | DIR 31 | 0.20 | 0.18 | 1.38 | 1.48 | 1.52 | 1.40 | 1.49 | 1.55 | 52 |
| 2B (comparison) | DIR 31 | DIR 32 | DIR 31 | 0.35 | 0.35 | 1.36 | 1.44 | 1.50 | 1.42 | 1.46 | 1.48 | 38 |
| 2C | DIR-V | DIR-V | DIR- | 0.20 | 0.18 | 1.05 | 1.22 | 1.30 | 1.15 | 1.20 | 1.45 | 40 |

TABLE 2-continued relating to example 2

| Layer structure | DIR coupler in 3rd & 4th layer | DIR coupler in 7th & 8th layer | DIR coupler in 11th & 12th layer | Average grain diameter in 7th layer µm | Average grain diameter in 11th layer µm | Colour separation blue/green with blue exposure $\Delta E_{pp}$ (10%) | Colour separation blue/green with blue exposure $\Delta E_{pp}$ (50%) | Colour separation blue/green with blue exposure $\Delta E_{pp}$ (90%) | Colour separation green/blue with green exposure $\Delta E_{gb}$ (10%) | Colour separation green/blue with green exposure $\Delta E_{gb}$ (50%) | Colour separation green/blue with green exposure $\Delta E_{gb}$ (90%) | Sharpness on white exposure (MTF = 50% at γ lines/mm) |
|---|---|---|---|---|---|---|---|---|---|---|---|---|
| (comparison) | 1 | 2 | 3 | | | | | | | | | |
| 2D (comparison) | DIR-V 1 | DIR-V 2 | DIR-V 3 | 0.35 | 0.35 | 1.07 | 1.25 | 1.32 | 1.10 | 1.22 | 1.42 | 32 |

pp = magenta
gb = yellow

Structural formulae of substances used:

UV 1

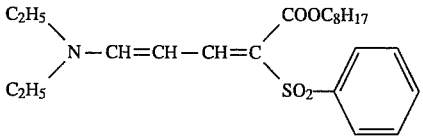

UV-2

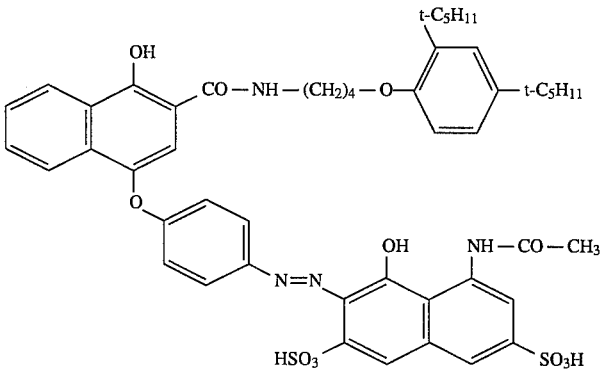

RM-1

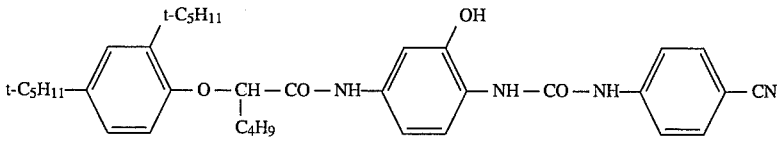

C-1

Copolymer of 70 wt.% of compound of the formula

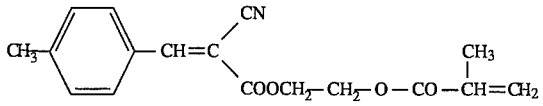

and 30 wt. % of methyl methacrylate,

-continued
C-2
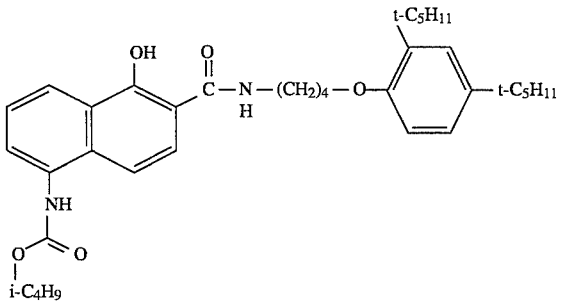
C-3
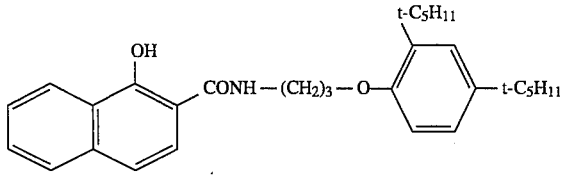
C-4
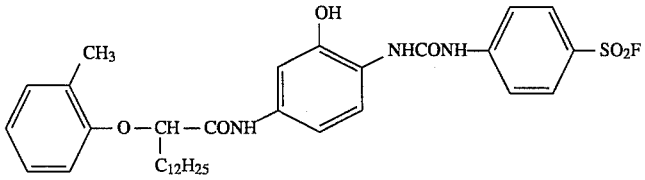
M-1
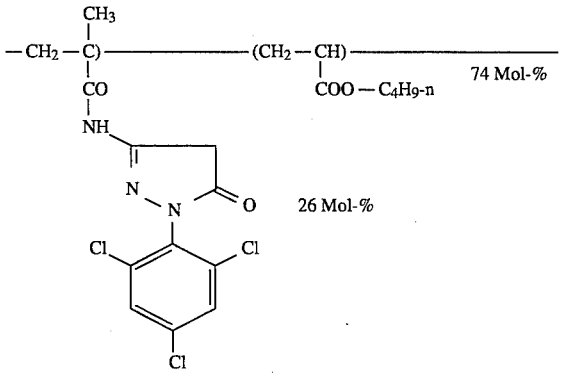
M-2
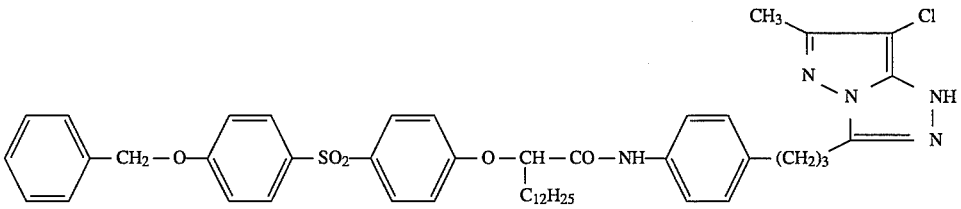
M-3
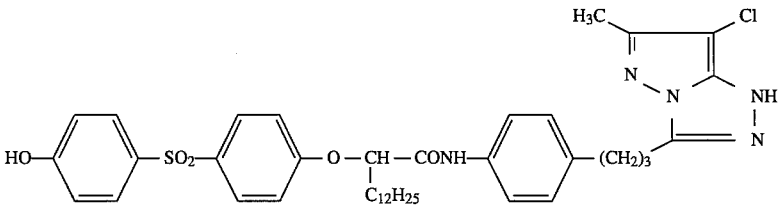

-continued
YM 1
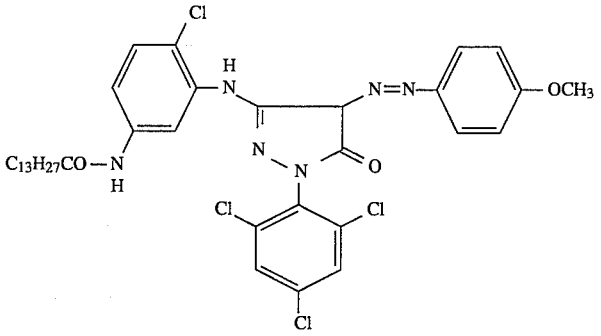
YM 1
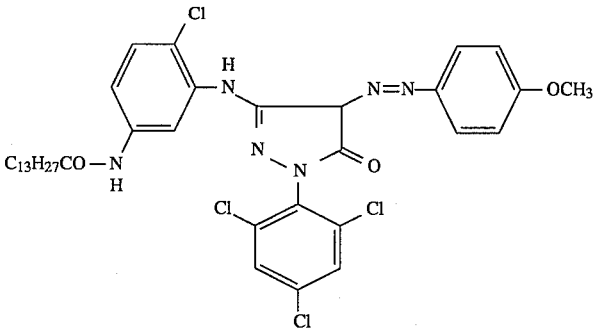
Y-1
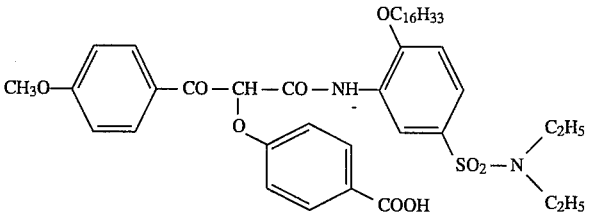
Y-2
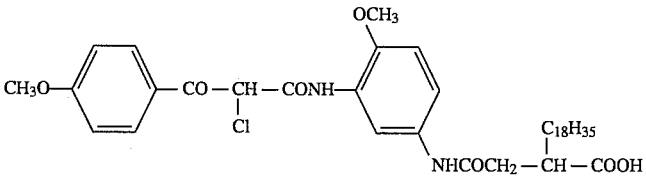
Y-3
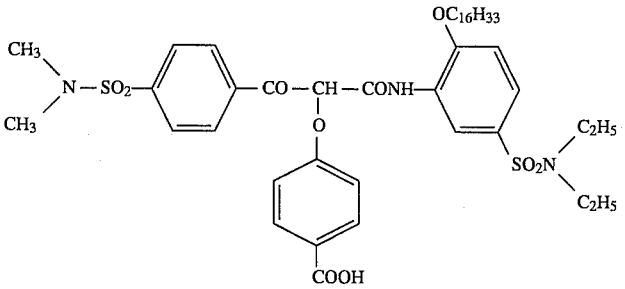
H-1
H-2
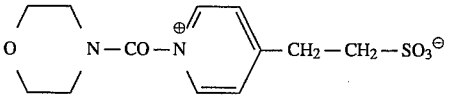

-continued

F-1

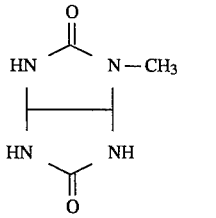

DIR-V1 (0,08)

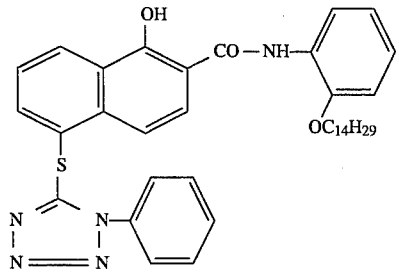

DIR-V2 (0,08)

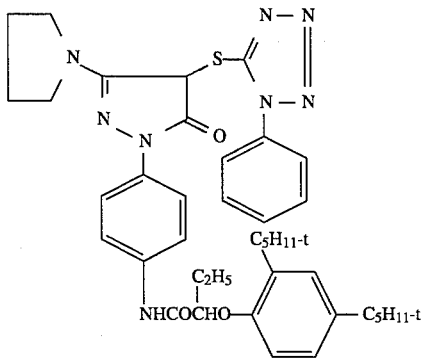

DIR-V3 (0,08)

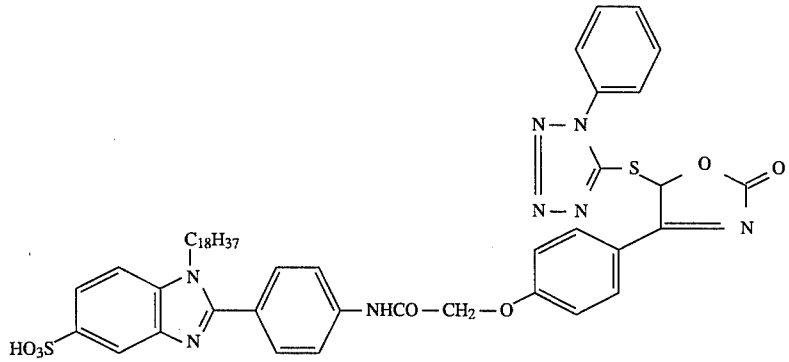

Sensitometric Method for Measurement of "Colour Separation"

The three colour density curves (gb, pp, bg), as obtained on a colour negative film with a white exposure (t=1/100 s behind a daylight filter and grey step wedge), are plotted on a graph of colour density D against exposure (log I.t)

The yellow and magenta curves are also plotted on the same graph after exposure with blue light behind a black step wedge, the intensity of the blue light being selected such that the thresholds of the yellow curves with white exposure and blue exposure correspond. The abbreviations gb, pp and bg here respectively mean yellow, magenta and cyan.

Delimitation of the blue/green colour separation with blue exposure due to the secondary blue sensitivity of the green-sensitive emulsion system in the pp layers may then be determined from the log(I.t) separation of the pp curve with a blue exposure in comparison with that with a green exposure.

This separation at Δlog (I.t) was measured at 10%, 50% and 90% of the density range between $D_{min}$ and $D_{max}$, i.e.

ΔE (10%) between points A and B at pp colour density=$D_{min}$ (pp)+0.1 [$D_{max}$ (pp)−$D_{min}$ (pp)]

ΔE (50%) between points A' and B' at pp colour density= $D_{min}$ (pp)+0.5 [$D_{max}$ (pp)−$D_{min}$ (pp)]

ΔE (90%) between points A" and B" at pp colour density= $D_{min}$ (pp)+0.9 [$D_{max}$ (pp)−$D_{min}$ (pp)]

and are shown in tables 1 and 2.

I claim:

1. A color photographic silver halide material comprising at least two blue-sensitive, yellow-coupler containing silver halide emulsion layers of differing photographic sensitivity, at least two green-sensitive, magenta coupler containing silver halide emulsion layers of differing photographic sensitivity and at least two red-sensitive, cyan-coupler containing silver halide emulsion layers of differing photographic sensitivity, characterised in that the silver halide emulsion of each of the highest sensitivity blue-sensitive and the highest sensitivity green-sensitive layers have iodide present and have an iodide content of from 1 to 4 mol % and an average particle size of the silver halide grains contained in the highest sensitivity blue- and green-sensitive emulsions is ≧0.65 μm and the silver halide emulsions of each of the lowest sensitivity blue-sensitive and the lowest sensitivity green-sensitive layers have an iodide content of ≧8 mol % and an average particle size of the silver halide grains contained in the lowest sensitivity blue- and green-sensitive emulsion is ≦0.3 μm, and which material contains at least one development inhibitor releasing "DIR" compound in an effective quantity to improve color separation, wherein the DIR compound is of the formula $$A—(L)_n—B$$

in which

A means the residue of a compound which, on reacting with the oxidation product of the color developer, liberates the group $—(L)_n—B$, B means the residue of a development inhibitor which is liberated from the group $—(L)_n—B$, L means a divalent binding link which, once the A—L bond is broken, is capable of breaking the L—B bond and n means 0 or 1, the inhibitor of which has diffusibility of ≧0.4, wherein particle size is expressed as the diameter of a sphere of equal volume.

2. The color photographic silver halide material according to claim 1, wherein the iodide content of the highest sensitivity blue- and green-sensitive emulsions is 1 to 4 mol % and that of the lowest sensitivity blue- and green-sensitive emulsions is 8 to 11 mol %.

3. The color photographic silver halide material according to claim 1, wherein the average particle size of the silver halide grains contained in the highest sensitivity blue-sensitive and the highest sensitivity green-sensitive emulsions are 0.65 to 1.30 μm and the average particle size of the silver halide grains contained in the lowest sensitivity blue- and the lowest sensitivity green-sensitive emulsions are 0.1 to 0.25 μm.

4. The color photographic silver halide material according to claim 1, wherein B is selected from the group consisting of the following formulae

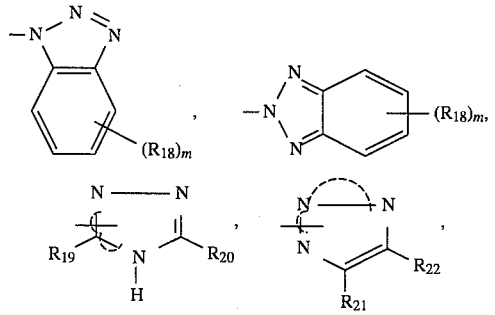

-continued

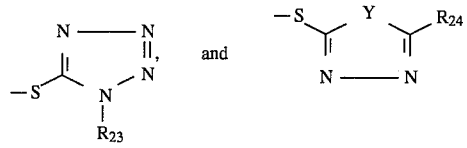

wherein

Y is O, S or $NR_{25}$ and $R_{18}$ is H, an unbranched, branched or cyclic aliphatic residue, halogen, $—NCOR_{31}$, $—OR_{31}$,

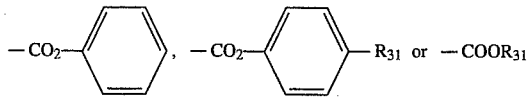

$R_{19}$ is H, halogen, an unbranched, branched or cyclic aliphatic residue, $—SR_{31}$, —S—aryl or —S—hetaryl, $R_{20}$ is an unbranched, branched or cyclic aliphatic residue, $—SR_{31}$, aryl or hetaryl, $R_{21}$ is hydrogen, an unbranched, branched or cyclic aliphatic residue or an aryl residue, $R_{22}$ is an unbranched, branched or cyclic aliphatic residue, $—SR_{31}$ or $—S—(CH_2)_n—COOR_{32}$, $R_{23}$ is an unbranched, branched or cyclic aliphatic residue or an unsubstituted or substituted phenyl group wherein said phenyl is substituted with a substituent or substituents which are selected from the group consisting of hydroxy, amino, sulphamoyl, carboxy and methoxycarbonyl, $R_{24}$ is an unbranched, branched or cyclic aliphatic residue, aryl, hetaryl, $—SR_{31}$ or an acylamino group, $R_{25}$ is H, an unbranched, branched or cyclic aliphatic residue, aryl, an acylamino group or a benzylideneamino group, $R_{31}$ is an unbranched, branched or cyclic aliphatic residue, $R_{32}$ is an unbranched, branched or cyclic aliphatic residue or an aryl residue m is 1 or 2 and n is an integer from 1 to 4.

5. The color photographic silver halide material according to claim 4, wherein $R_{18}$ means H, $CH_3$, Cl, Br, $C_1$–$C_6$ alkoxy, $C_1$–$C_6$ alkylcarbonylamino, or phenoxycarbonyl, $R_{19}$ means $C_1$–$C_{10}$ alkylthio, $R_{20}$ means H or 2-furyl, $R_{21}$ means H or $C_1$–$C_4$ alkyl, $R_{22}$ means $C_1$–$C_6$ alkylthio, $C_1$–$C_8$ alkoxycarbonyl or $C_1$–$C_6$-alkylcarbonyloxy-$C_1$–$C_4$-alkenethio, $R_{23}$ means an unsubstituted or substituted $C_1$–$C_6$ alkyl, wherein said $C_1$–$C_6$-alkyl is substituted with di-$C_1$–$C_4$-alkylamino; or unsubstituted or mono- or di-substituted phenyl wherein said mono- or di-substituted phenyl is substituted with a substituent or substituents which are selected from the group consisting of hydroxy, $C_1$–$C_4$ alkyl, methoxycarbonyl, aminosulphonyl and chloroethoxycarbonyl, $R_{24}$ means $C_1$–$C_6$ alkyl, amino or 2-furyl, $R_{25}$ means H, $C_1$–$C_6$ alkylcarbonylamino or

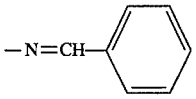

$R_{26}$ means $NO_2$, $R_{27}$ means $C_1$–$C_4$ alkyl, $R_{28}$ means $C_1$–$C_{20}$ alkyl or phenyl, $R_{29}$ means H or $C_1$–$C_4$ alkyl, $R_{30}$ means unsubstituted phenyl or phenyl substituted with chlorine, $R_{35}$ means phenyl or nitrophenyl, Z means oxygen.

6. The color photographic silver halide material according to claim 1, wherein —L—B is selected from the group consisting of the formulae:

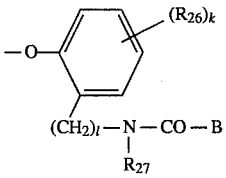

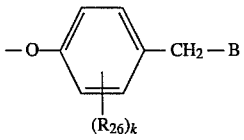

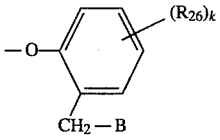

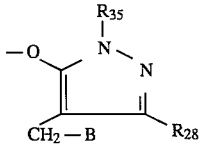

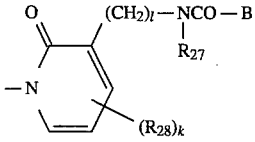

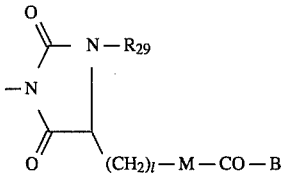

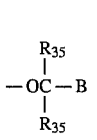

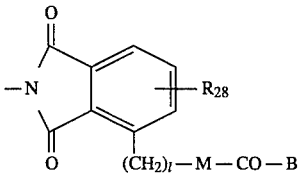

and

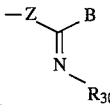

in which k means 1 or 2, l means 0, 1 or 2, $R_{26}$ means hydrogen, alkyl, aryl, hetaryl, halogen, nitro, cyanogen, alkylthio, acylamino, sulphamoyl, alkoxycarbonylamino or amino, $R_{27}$ means hydrogen, alkyl, aryl or aralkyl, $R_{28}$ means hydrogen, halogen, alkyl, aralkyl, alkoxy, anilino, acylamino, ureido, cyanogen, sulphonamido, aryl or carboxy, $R_{29}$ means hydrogen, alkyl, aralkyl, cycloalkyl or aryl, M means

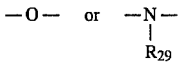

$R_{30}$ means alkyl, aralkyl, aryl, acyl, hetaryl, acylamino, $—OR_{33}$ or $—PO(OR_{33})_2$, $R_{33}$ means alkyl, or aryl or hetaryl, Z means

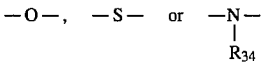

$R_{34}$ means hydrogen, alkyl, aryl, alkylsulphonyl or arylsulphonyl and $R_{35}$ means hydrogen, alkyl or aryl.

7. The color photographic silver halide material according to claim 1, wherein at least one development inhibitor releasing compound is contained in an amount from 50 to 500 mg.

8. The color photographic silver halide material as claimed in claim 1, wherein said blue, green and red silver halide emulsions are silver bromide-iodide or silver bromide-iodide-chloride emulsions with a chloride content of less than 20 mol %.

9. The color photographic silver halide material as claimed in claim 8, wherein the silver halide emulsion are silver bromide-iodide emulsions.

10. The color photographic silver halide material according to claim 1, wherein the development inhibitor releasing "DIR" compound is selected from the group consisting of DIR-1
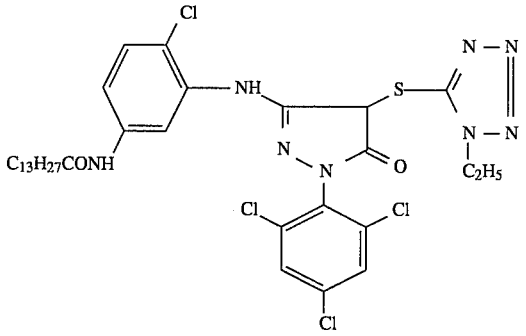
DIR-2
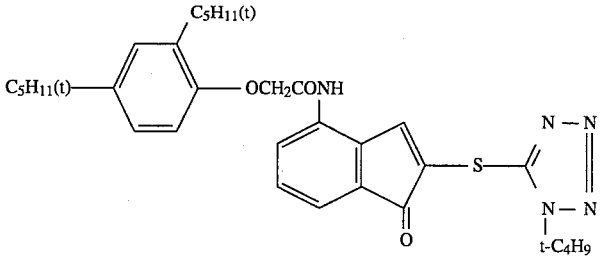
DIR-3
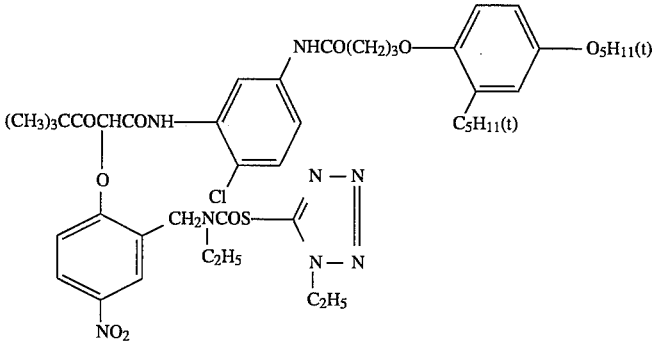
DIR-4
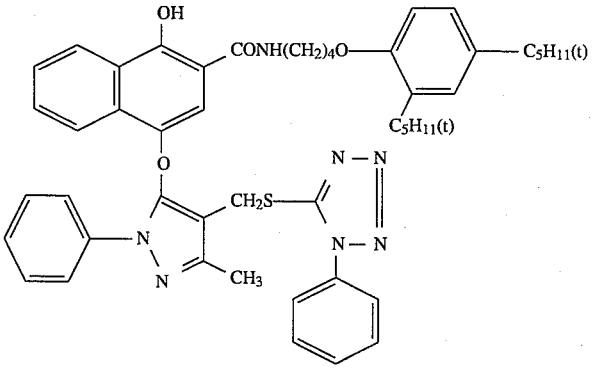
DIR-5
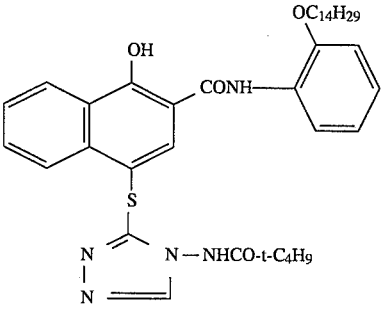

-continued
DIR-6
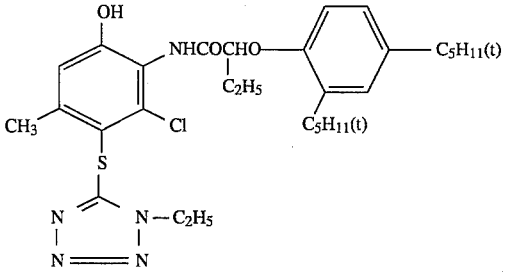
DIR-7
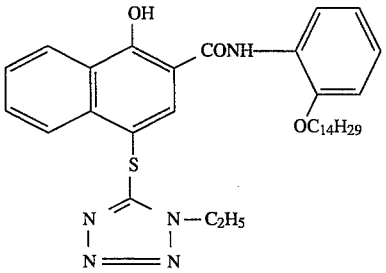
DIR-8
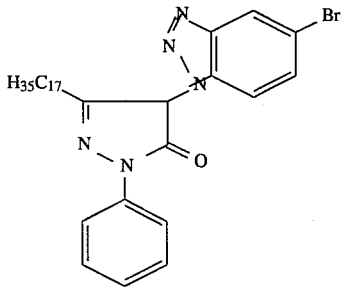
DIR-9
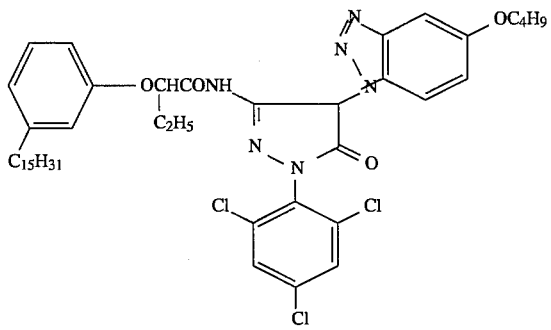
DIR-10
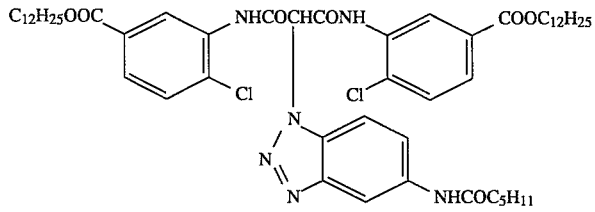

-continued
DIR-11
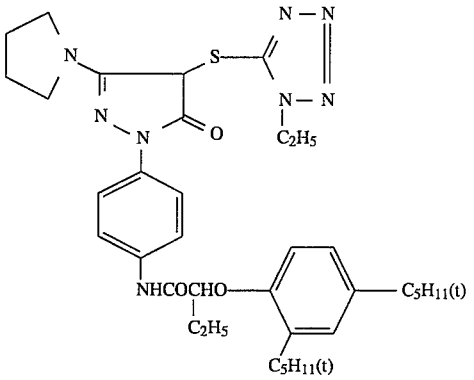
DIR-12
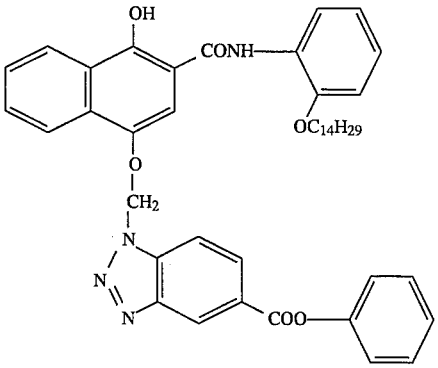
DIR-13
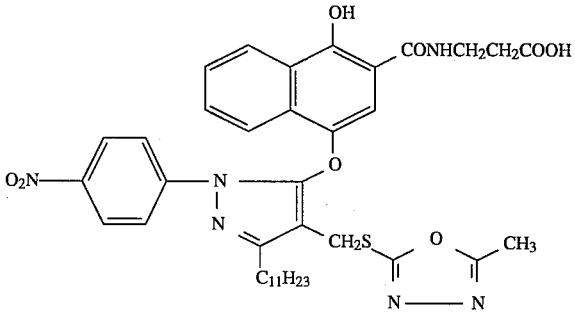
DIR-14
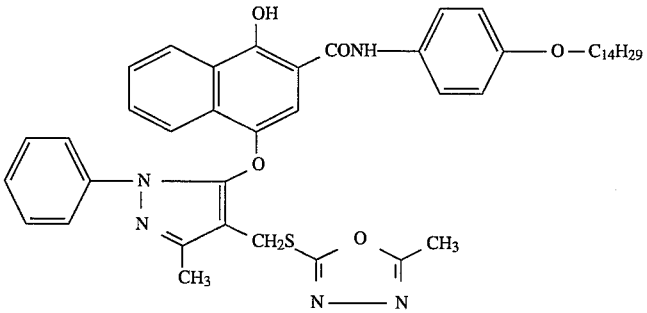

-continued
DIR-15
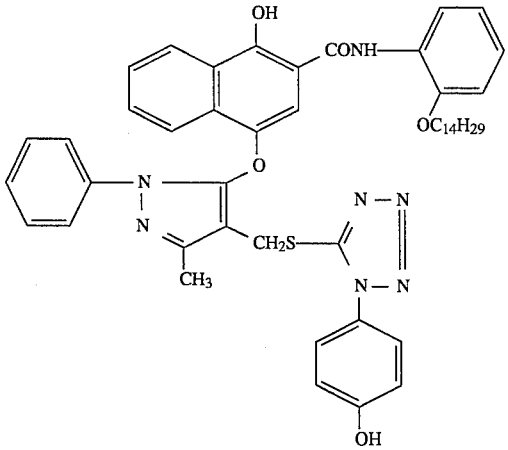
DIR-16
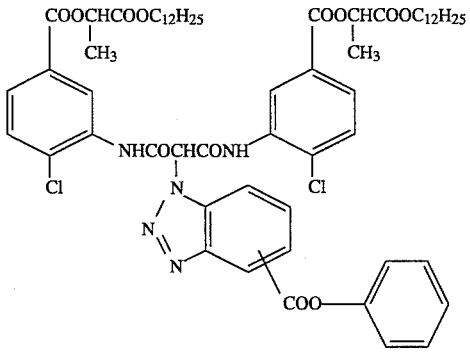
DIR-17
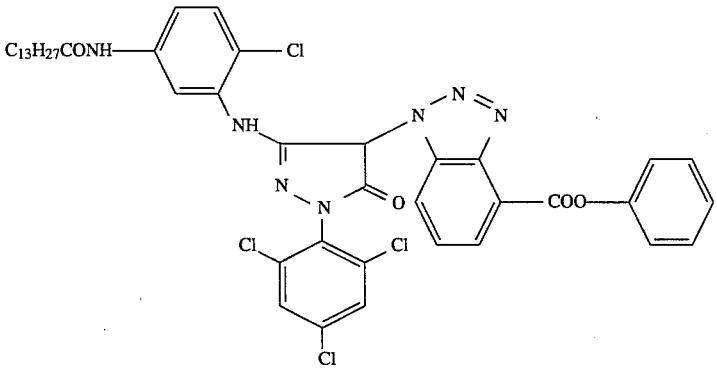
DIR-18
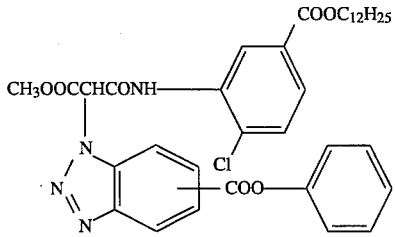

-continued
DIR-19
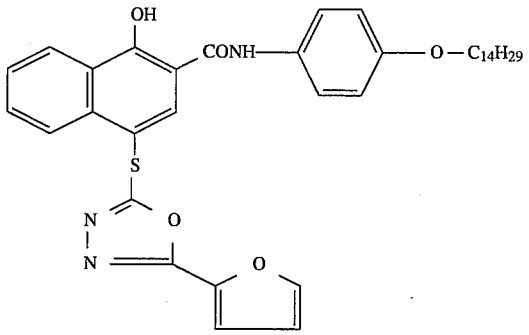
DIR-20
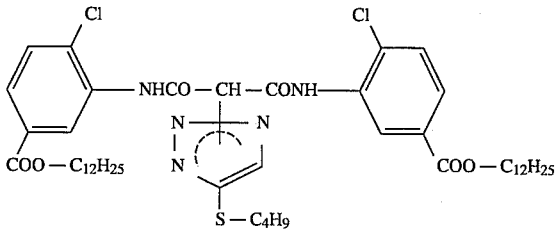
DIR-21
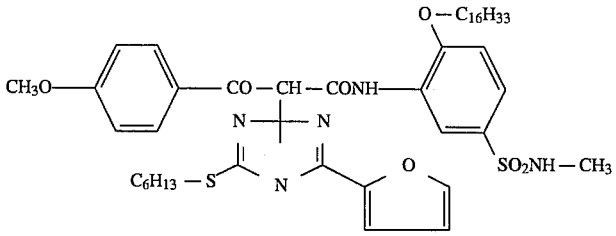
DIR-22
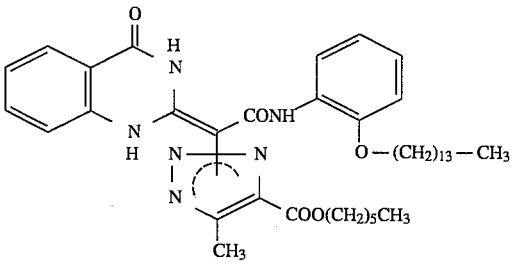
DIR-23
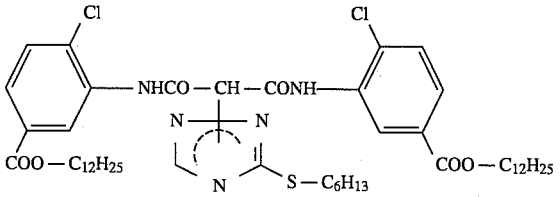
DIR-24
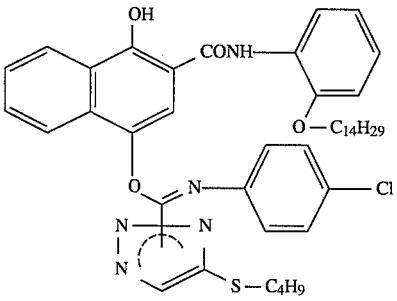

-continued
DIR-25
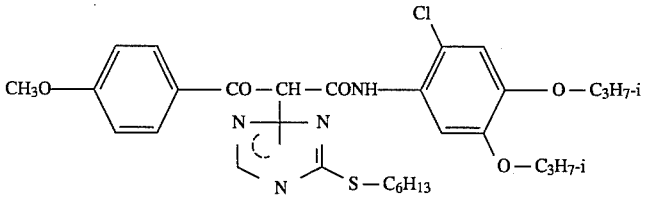
DIR-26
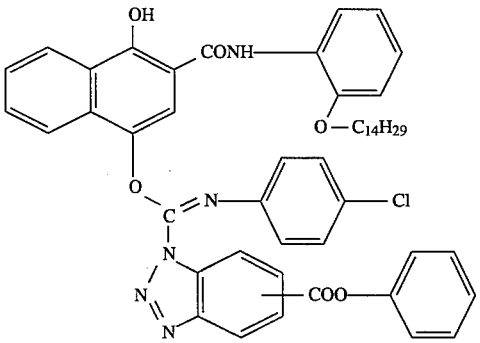
DIR-27
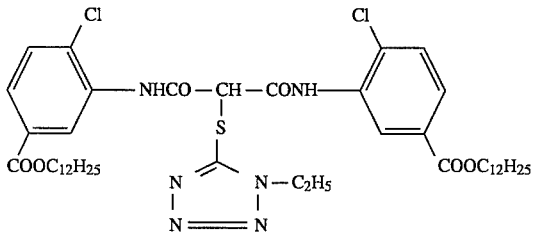
DIR-28
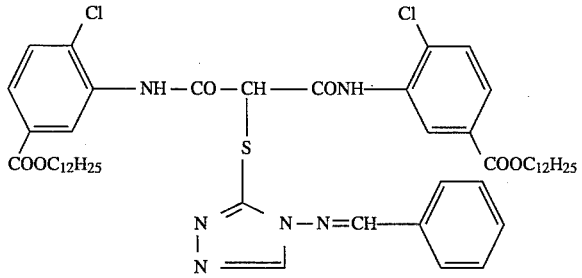
DIR-29
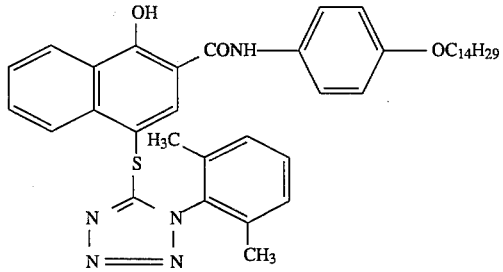
DIR-30
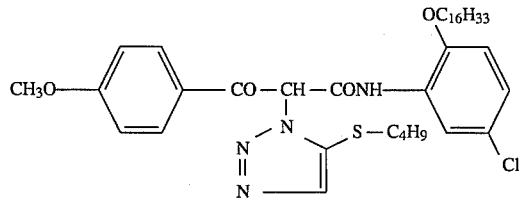

-continued
DIR-31
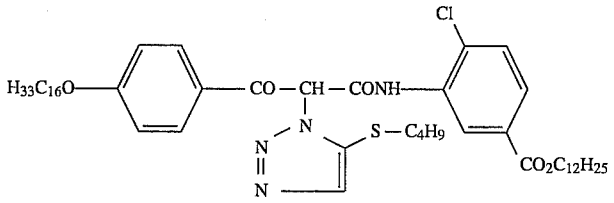
and
DIR-32
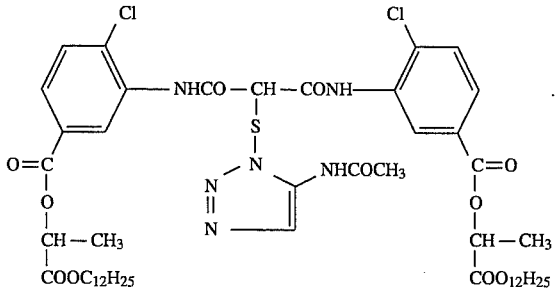
* * * * *